US008567906B2

(12) United States Patent
Shinozaki

(10) Patent No.: US 8,567,906 B2
(45) Date of Patent: Oct. 29, 2013

(54) IMAGE FORMING APPARATUS AND METHOD OF MAKING THE IMAGE FORMING APPARATUS

(75) Inventor: Kenichi Shinozaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 4 days.

(21) Appl. No.: 13/234,295

(22) Filed: Sep. 16, 2011

(65) Prior Publication Data

US 2012/0069090 A1 Mar. 22, 2012

(30) Foreign Application Priority Data

Sep. 16, 2010 (JP) ..... 2010-207681

(51) Int. Cl.
*B41J 2/15* (2006.01)

(52) U.S. Cl.
USPC ..... 347/40

(58) Field of Classification Search
USPC ..... 347/40, 49
See application file for complete search history.

(56) References Cited

U.S. PATENT DOCUMENTS

| | | | | |
|---|---|---|---|---|
| 5,782,184 | A * | 7/1998 | Albertalli et al. | 101/486 |
| 6,068,367 | A * | 5/2000 | Fabbri | 347/49 |
| 7,665,815 | B2 * | 2/2010 | Swett et al. | 347/9 |
| 2005/0280675 | A1 * | 12/2005 | Bibl et al. | 347/68 |

FOREIGN PATENT DOCUMENTS

| | | |
|---|---|---|
| JP | 3319492 | 6/2002 |
| JP | 2002-316415 | 10/2002 |
| JP | 2003-154724 | 5/2003 |
| JP | 2006-248076 | 9/2006 |
| JP | 4377138 | 9/2009 |
| JP | 2010-30271 | 2/2010 |
| JP | 452313 | 6/2010 |

* cited by examiner

*Primary Examiner* — Matthew Luu
*Assistant Examiner* — Michael Konczal
(74) *Attorney, Agent, or Firm* — Cooper & Dunham LLP

(57) ABSTRACT

An image forming apparatus includes a plurality of heads and a head support member. Each head has multiple nozzles arrayed in at least one row to eject liquid droplets. The support member has first and second positioning portions to position each head. Each head has a first positioning face to position each head in a nozzle array direction and a second positioning face to position each head in a direction perpendicular to the nozzle array direction. The first positioning face and the second positioning face are cut faces formed by cutting. Each of a first distance between the first positioning face and a first reference nozzle and a second distance between the second positioning face and a second reference nozzle is uniform between the heads. Each head is mounted to the support member with the first and second positioning faces contacting the first and second positioning portions, respectively.

8 Claims, 7 Drawing Sheets

IMAGE FORMING APPARATUS AND METHOD OF MAKING THE IMAGE FORMING APPARATUS

CROSS-REFERENCE TO RELATED APPLICATIONS

This patent application is based on and claims priority pursuant to 35 U.S.C. §119 to Japanese Patent Application No. 2010-207681, filed on Sep. 16, 2010 in the Japan Patent Office, the entire disclosure of which is hereby incorporated herein by reference in its entirety.

TECHNICAL FIELD

This disclosure relates to an image forming apparatus and a method of making the image forming apparatus, and more specifically to an image forming apparatus including a plurality of recording heads to eject liquid droplets and a method of making the image forming apparatus.

DESCRIPTION OF THE BACKGROUND ART

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid-droplet ejection head) for ejecting droplets of ink. During image formation, such liquid-ejection-type image forming apparatuses eject droplets of ink or other liquid from the recording head onto a recording medium to form a desired image. Such liquid-ejection-type image forming apparatuses fall into two main types: a serial-type image forming apparatus that forms an image by ejecting droplets from the recording head while moving the carriage with the recording head in a main scanning direction, and a line-head-type image forming apparatus that forms an image by ejecting droplets from a linear-shaped recording head held stationary in the image forming apparatus as the recording medium is conveyed thereto.

Such a liquid-ejection-type image forming apparatus may have multiple recording heads to eject liquid droplets of different colors to form a composite color image or a line-type recording head unit in which multiple recording heads are arrayed in a direction in which nozzles are arrayed in each of the recording heads. In such configurations, the multiple recording heads are relatively positioned at high precision to increase the accuracy of positions at which droplets ejected from each of the multiple recording heads land on a recording medium to form a high-quality image.

In addition, if ejection failure occurs in one or more of the multiple recording heads, it is necessary to replace a defective recording head with a new one while reproducing the highly-precise positioning of the heads.

Hence, conventionally, for example, JP-20030154724-A proposes a head holder that collectively holds the multiple recording heads and is mounted on a carriage so that the position of the head holder is adjustable. In addition, JP-2010-30271-A proposes to hold a nozzle plate or channel plate formed at high precision with respect to X, Y, and Z directions in contact with ribs of a base member.

JP-H07-314851-B proposes a head position adjustment mechanism that includes recording heads, a carriage, and urging springs. The carriage has head positioning faces to position the recording heads in a sheet feed direction parallel to a scanning shaft of the carriage and head guide grooves perpendicular to the scanning shaft. The recording heads have engagement portions to engage the head guide grooves to restrict movement in the scanning direction and contact faces formed back and forth in the scanning direction corresponding to the head positioning faces. The urging springs urge the contact faces of the recording heads against the head positioning faces of the carriage. With reference to on one head brought into contact with one head positioning face, the other heads are brought into contact with the other head positioning faces via a required number of adjustment plates to adjust relative positions between the recording heads.

JP-2002-316415-A proposes to accurately finish by a machining finish device a reference face of each head abutment section of a frame body to which multiple head chips are inserted, in order to determine relative positions of the multiple head chips in adjustable manner by shifting respective heads with each other at certain intervals in a direction in which nozzles are arrayed in row.

However, for the configuration described in JP-20030154724-A, head replacement need be performed in unit of the head holder including the multiple recording heads. For the configuration described in JP-2010-30271-A, a portion of the nozzle plate or channel plate that contacts the ribs need be formed at high precision.

The configuration described in JP-H7-314851-B requires a complex position adjustment mechanism, thus increasing cost of the carriage. In addition, such a complex position adjustment mechanism tends to be difficult to apply to the multiple recording heads. The positions of all recording heads need be readjusted in replacing a reference head of the multiple recording heads, thus hampering easy head replacement.

BRIEF SUMMARY

In an aspect of this disclosure, there is provided an image forming apparatus including a plurality of heads and a head support member. The plurality of heads ejects liquid droplets, each of the plurality of heads having multiple nozzles arrayed in at least one row to eject liquid droplets. The head support member mounts the plurality of heads and has a first positioning portion and a second positioning portion to position each of the plurality of heads. Each of the plurality of heads has a first positioning face to position the each of the plurality of heads in a nozzle array direction in which the nozzles of each of the plurality of heads are arrayed in at least one row and a second positioning face to position the each of the plurality of heads in a direction perpendicular to the nozzle array direction. The first positioning face and the second positioning face are cut faces formed by cutting. Each of a first distance between the first positioning face and a first reference nozzle of the nozzles of each of the plurality of heads and a second distance between the second positioning face and a second reference nozzle of the nozzles of each of the plurality of heads is uniform between the plurality of heads. Each of the plurality of heads is mounted to the head support member with the first positioning face and the second positioning face contacting the first positioning portion and the second positioning portion, respectively.

In another aspect of this disclosure, there is provided a method of making an image forming apparatus having a plurality of heads to eject liquid droplets, each of the plurality of heads having multiple nozzles arrayed in at least one row to eject liquid droplets; and a head support member to mount the plurality of heads. The method includes cutting at least one portion of an outer surface of each of the plurality of heads in each direction of a nozzle array direction in which nozzles of each of the plurality of heads are arrayed in at least one row and a direction perpendicular to the nozzle array direction at a predetermined distance from a given reference nozzle of the nozzles of each of the plurality of heads to form a first positioning face in the nozzle array direction and a second positioning face in the direction perpendicular to the nozzle array direction; and contacting the first positioning face and the second positioning face with a first positioning portion and a second positioning portion, respectively, of the head support member to mount each of the plurality of heads to the head support member.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
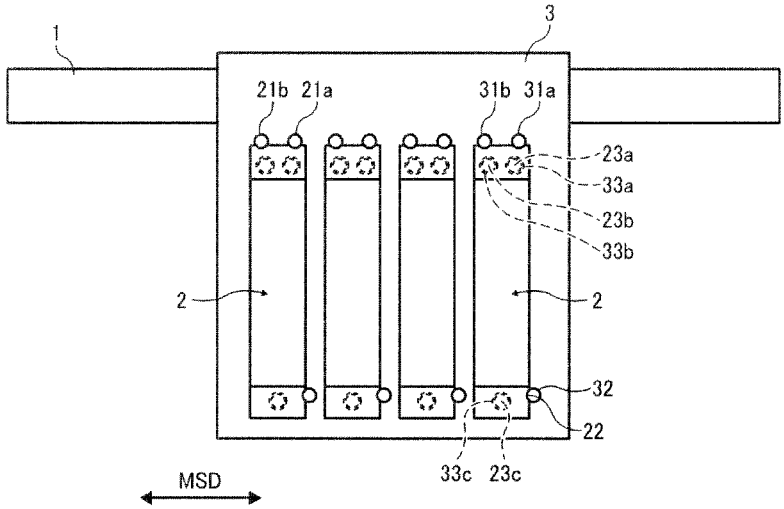
FIG. 1 is a plan view of a carriage section in an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In this disclosure, the term "image forming apparatus" of liquid ejection type refers to an apparatus that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium. The term "ink" as used herein is not limited to "ink" in a narrow sense and includes anything useable for image formation, such as recording liquid, fixing solution, liquid, DNA sample, resist, pattern material, and resin. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, a recording sheet, and a recording paper sheet. The term "image" used herein is not limited to a two-dimensional image and includes, for example, an image applied to a three dimensional object and a three dimensional object itself formed as a three-dimensionally molded image.

Referring now to the drawings, wherein like reference numerals designate identical or corresponding parts throughout the several views, exemplary embodiments of the present disclosure are described below. Next, an exemplary embodiment of the present disclosure is described with reference to FIGS. 1 to 3.

Figure 2:
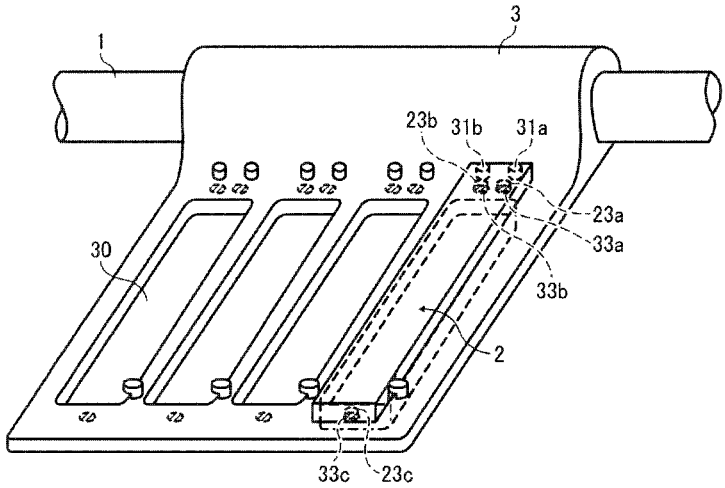
FIG. 2 is a perspective view of the carriage section of FIG. 1.
Figure 3:
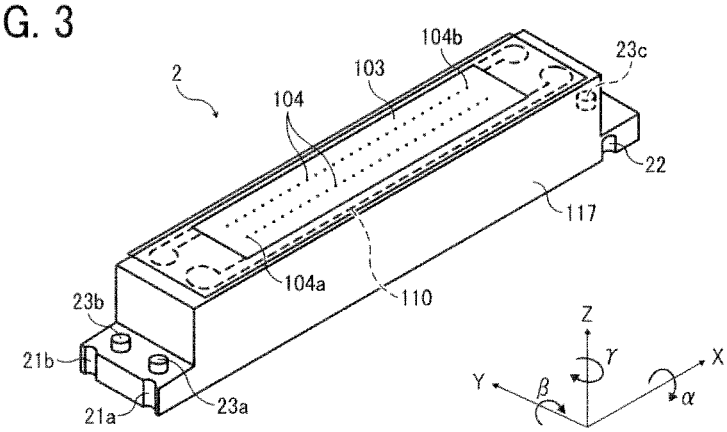
FIG. 3 is a perspective view of a head mountable on the carriage section of FIG. 1.

FIG. 1 is a plan view of a carriage section in this exemplary embodiment. FIG. 2 is a perspective view of the carriage section illustrated in FIG. 1. FIG. 3 is a perspective view of a recording head in this exemplary embodiment.

In this exemplary embodiment, four liquid ejection heads 2 (hereinafter, referred to as "heads") are mounted on a carriage 3 serving as a head support member that is movable for scanning reciprocatingly in a main scanning direction along a guide rod 1. The heads 2 are mounted to the carriage 3 with respective nozzle faces thereof being oriented downward so as to face openings 30 of the carriage 3.

As illustrated in FIG. 3, each head 2 has a nozzle plate 103 at a surface thereof. The nozzle plate 3 has multiple nozzles 104 to eject liquid droplets (a surface of the nozzle plate 103 is referred to as "nozzle face"). Each head 2 is covered with a frame member 117 having a common chamber inside. The frame member 117 is injection molded from, for example, epoxy resin or polyphenylene sulfite (PPS).

Here, as illustrated in FIG. 3, the coordinate axes used herein are X, Y, and Z axes, and rotations of the X, Y, and Z axes are represented by $\alpha$, $\beta$, and $\gamma$. The X-axis corresponds to a direction (nozzle array direction) in nozzles 104 are arrayed in line. The Y-axis corresponds to a direction (crossing direction) perpendicular to the nozzle array direction. The Z-axis corresponds to a direction (droplet ejection direction) in which liquid droplets are ejected from the nozzles 104 of each head 2).

An outer surface of the frame member 117 of each head 2 has first positioning faces 21*a* and 21*b*, a second positioning face 22, and third positioning faces 23*a*, 23*b*, and 23*c* that are formed by cutting work (including laser machining). The first positioning faces 21*a* and 21*b* (referred to as "first positioning faces 21" unless distinguished) position the head 2 in the nozzle array direction. The second positioning face 22 positions the head 2 in the direction perpendicular to the nozzle array direction. The third positioning faces 23*a*, 23*b*, and 23*c* (referred to as "the third positioning faces 23" unless distinguished) position the head 2 in the droplet ejection direction.

The first positioning faces 21*a* and 21*b* are formed at a surface of a first end portion of the head 2 in the nozzle array direction. The second positioning face 22 is formed at one end face of the head 2 in the direction perpendicular to the nozzle array direction and at a second end portion opposite the first end portion in which the first positioning faces 21*a* and 21*b* are formed in the nozzle array direction. Although the first positioning faces 21*a* and 21*b* are two in FIG. 3, the frame member 117 may have at least one first positioning face to position the head 2 in the nozzle array direction. The third positioning faces 23*a* and 23*b* are formed at the first end portion in which the first positioning faces 21*a* and 21*b* are formed, and the third positioning face 23*c* is formed at the second end portion opposite the first end portion in the nozzle array direction. The third positioning faces 23*a*, 23*b*, and 23*c* are formed by machining projections of the frame member 117.

Each of the first positioning faces 21*a* and 21*b* is formed at a uniform distance from a certain nozzle 104, e.g., a first reference nozzle 104*a* at an end in the nozzle array direction, between the heads 2. Likewise, the second positioning face 22 is formed at a uniform distance from a certain nozzle 104, e.g., a second reference nozzle 104*b* at an end in the nozzle array direction, between the heads 2. Each of the third positioning faces 23*a*, 23*b*, and 23*c* is formed at a uniform distance from the nozzle face between the heads 2.

After the head 2 is produced, the outer surface of the head 2 is cut to from the first to third positioning faces. Thus, between at least two heads of the heads 2, each of the distances from the first and second positioning faces to the certain nozzles can be uniform and each of the distances from the third positioning faces to the nozzle face can be uniform.

Each head 2 is mounted to the carriage 3 with the first positioning faces 21*a* and 21*b* contacting first contact portions 31*a* and 31*b* serving as first positioning portions of the carriage 3, the second positioning face 22 contacting a second contact portion 32 serving as a second positioning portion of the carriage 3, and the third positioning faces 23*a*, 23*b*, and 23*c* contacting third contact portions 33*a* to 33*c* serving as third positioning portions of the carriage 3.

The first to third contact portions 31 to 33 serving as the first to third positioning portions are formed at high precision. Each head 2 is urged with an urging member, e.g., spring in a direction to contact the first to third positioning faces to the first to third contact portions 31 to 33.

The mounting tolerance on the contact of the positioning faces with the contact portions is, for example, 1 to 2 μm.

Thus, the multiple recording heads can be positioned at high precision relative to each other and mounted to the head support member (carriage). Between the heads 2, each of the distances between the first and second positioning faces and the certain nozzles is uniform, and each of the distances between the third positioning faces and the nozzle face is uniform. Accordingly, the highly precise positioning can be reproduced in head replacement, thus facilitating head replacement.

Figure 4:
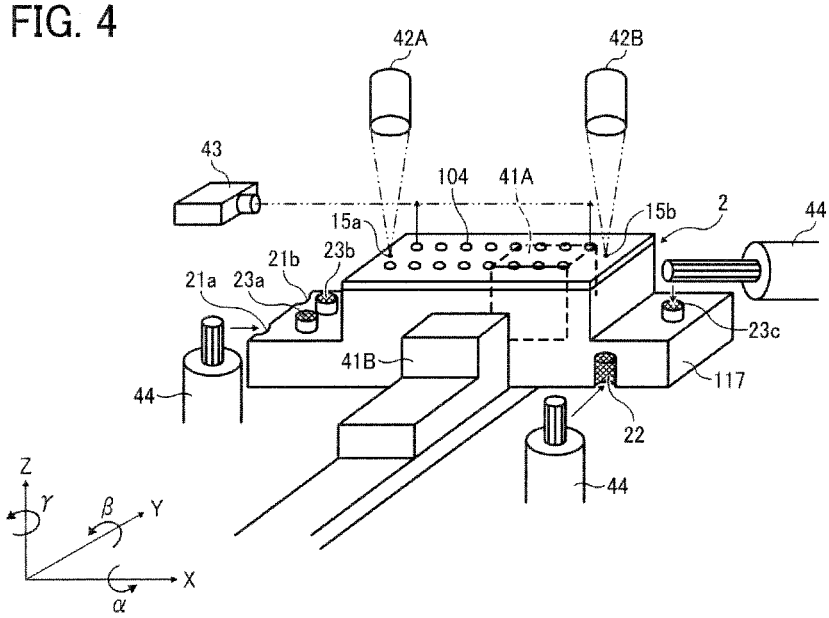
FIG. 4 is a perspective view of the head in processing positioning faces.

Next, cutting of the first to third positioning faces of the head 2 is described with reference to FIG. 4.

After the head 2 is produced, the head 2 is fixedly held with holding members 41A and 41B from, for example, the direction perpendicular to the nozzle array direction. While monitoring a flat surface of the nozzle plate 103 and alignment marks 15*a* and 15*b* (or, e.g., the above-described reference nozzles 104*a* and 104*b* at both ends) with two cameras (imaging devices) 42A and 42B and an auto collimator 43, the head 2 is moved to a predetermined normal position on a stage and aligned with respect to each coordinate of X, Y, Z, α, β, and γ.

After it is confirmed that the head 2 is aligned at a precision of, for example, 3 μm, end mills 44 cut the outer surface of the heads 2 simultaneously or one by one to form the first and second positioning faces 21 and 22. Meanwhile, air is suctioned around spindles of the end mills 44 to suction cut pieces and dust, thus preventing scattering of such dust.

In this regard, the frame member 117 of the heads 2 is molded in advance with a positive tolerance so that a cut margin is not lost by a variance in tolerance, thus preventing non-formation of positioning faces due to variance in molding.

As described above, by forming the positioning faces after construction of the head, each of the distances from the positioning faces to certain nozzles or the nozzle face can be uniformed between the multiple recording heads.

In other words, if a configuration is employed in which the positioning faces are integrally formed with the frame member or other member in advance, variance in assembling the head might cause variance in the relative positions of the nozzle plate (or nozzles) requiring positional adjustment and the positioning faces between the multiple heads. In such a case, when the head is mounted to the head support member, the positions of nozzles need be adjusted with, for example, a camera, thus hampering smooth head replacement.

By contrast, in this exemplary embodiment, by forming the positioning faces after construction of the head, the relative positions of the positioning portions of the head support member and nozzles (or the nozzle plate) can be determined at high precision in a simple contact manner. In other words, the positions of the positioning faces and the nozzles can be determined at high precision and the highly precise positions can be reliably and simply reproduced, thus facilitating head replacement.

Next, an example of the head 2 serving as liquid ejection head is described with reference to FIG. 5.

Figure 5:
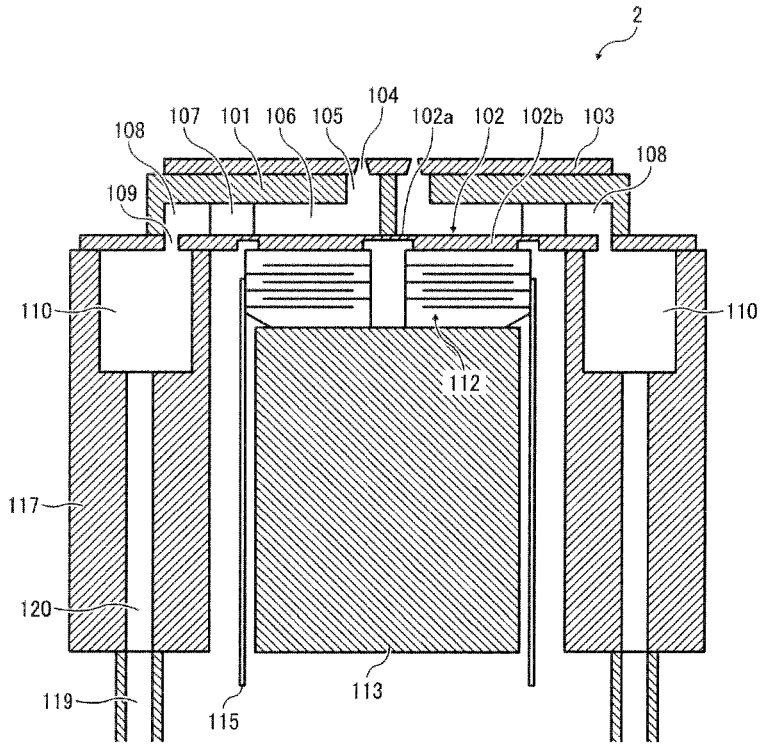
FIG. 5 is a cross sectional view of an example of the head cut along a long direction of chambers.

FIG. 5 is a cross-sectional view of the head 2 illustrated in FIG. 3 cut along a long direction of chambers.

The head 2 includes a channel plate (channel substrate or chamber substrate) 101 serving as channel member, a diaphragm member 102 bonded on a first surface of the channel plate 101, and a nozzle plate 103 bonded on a second surface of the channel plate 101 opposite the first surface bonded on the diaphragm member 102. The channel plate 101, the diaphragm member 102, and the nozzle plate 103 collectively forms multiple pressure chambers 106 serving as independent channels which multiple nozzles 104 to eject liquid droplets communicate via nozzle communication channels 105. Ink is supplied from common chambers 110 of the frame member 117 via inlets 109, inflow portions 108, and fluid resistant portions 107.

For the channel plate 101, a silicon substrate is anisotropically etched to form openings and channels, such as the nozzle communication channels 105, the pressure chambers 106, the fluid resistant portions 107, and the inflow portions 108. The diaphragm member 102 is a wall member to form a wall surface of each of the pressure chambers 106 and the fluid resistant portions 107. The diaphragm member 102 has a plurality of vibration areas (diaphragm portions) 102*a* corresponding to the pressure chambers 106. The vibration areas 102*a* have convex portions 102*b* arranged in islands at an outer side of the vibration areas 2*a* (opposite an inner side facing the pressure chambers 6). The convex portions 102*b* are bonded to piezoelectric actuators (piezoelectric pillars) 112 that are laminated in pillar shape and serve as driving elements (actuator devices or pressure generation devices) to deform the vibration areas 2*a* to generate energy for ejecting liquid droplets. The bottom faces of the piezoelectric pillars 112 are bonded to a base member 113, and flexible printed circuits (FPC) 115 are connected to the piezoelectric pillars 112 to transmit drive signals to the piezoelectric pillars 112.

The nozzle plate 103 is formed from a metal plate of, e.g., nickel (Ni) by electroforming. The nozzle plate 103 has the nozzles 104 of a diameter of, e.g., 10 to 35 μm corresponding to the respective pressure chambers 106 and is bonded to the channel plate 101 with glue. A liquid-repellent layer is formed on a droplet ejection surface of the nozzle plate 103 (a front-side surface of the nozzle plate 103 in a direction in which liquid droplets are ejected from the nozzle plate 103) opposite a surface of the nozzle plate 103 facing the pressure chambers 6.

On an outer circumferential side of a piezoelectric actuator unit including the piezoelectric pillars 112 connected to the FPCs 115 and the base member 113 is bonded the frame member 117 that is formed by injection molding of, for example, epoxy resin or polyphenylene sulfite. The common chambers 110 are formed in the frame member 117. Supply ports 120 are formed in the frame member 117 to supply ink or other recording liquid from external ink-supply sources, such as ink cartridges or sub tanks, to the common chambers 110 through connection tubes 119, and the connection tubes 119 are connected to the ink-supply sources.

For the head 2, the piezoelectric pillars 112 are diced at intervals of 300 dots per inch (dpi) and arranged in two opposing rows. The pressure chambers 106 and the nozzles 104 are arranged in two opposing rows in a staggered way so as to have intervals of 150 dpi in each of the two rows. Such a configuration can obtain a resolution of 300 dpi at single scanning.

In the liquid ejection head 2 having such a configuration, for example, when the voltage applied to the piezoelectric pillars 112 is lowered below a reference potential, the piezoelectric pillars 112 contract. As a result, the diaphragm portions (vibration areas) 102*a* of the diaphragm member 102 forming wall surfaces of the pressure chambers 106 move downward to expand the volume of the pressure chambers 106, thus causing ink to flow into the pressure chambers 106. Then, increasing the voltage applied to the piezoelectric pillars 112 extends the piezoelectric pillars 112 in a direction (laminated direction) in which piezoelectric elements are laminated in each piezoelectric pillar 112. As a result, the diaphragm portions 102*a* of the diaphragm member 102 are deformed toward the nozzles 104 to reduce the volume of the pressure chambers 106. Thus, pressure is applied to ink in the pressure chambers 106, thus ejecting droplets of ink from the nozzles 104.

Returning the voltage applied to the piezoelectric pillars 112 to the reference potential returns the diaphragm member 102 to the original position, thus expanding the pressure chambers 106. As a result, negative pressure occurs in the pressure chambers 106, thus refilling ink from the common chambers 110 to the pressure chambers 106. After vibration of a meniscus of each nozzle 104 decays and stabilizes, the process goes to operation for the next droplet ejection.

The method of driving the head is not limited to the above-described example (pull-push ejection). For example, pull ejection or push ejection may be performed by changing the method of applying driving waveform.

Next, an image forming apparatus according to an exemplary embodiment of the present disclosure is described with reference to FIGS. 6 and 7.

Figure 6:
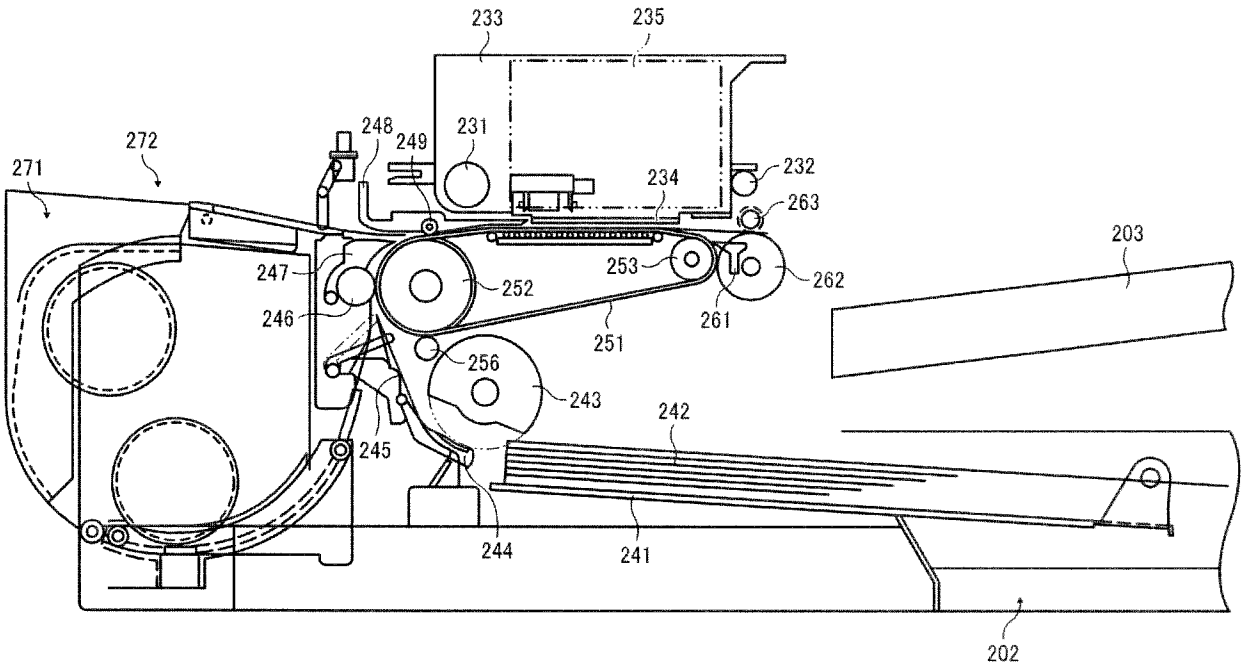
FIG. 6 is a schematic side view of an image forming apparatus according to an exemplary embodiment of this disclosure.

FIG. 6 is a side view of a schematic configuration of the image forming apparatus. FIG. 7 is a plan view of the image forming apparatus of FIG. 6.

The image forming apparatus is a serial-type image forming apparatus and includes a left-side plate 221A, a right-side plate 221B, a main guide rod 231, a sub guide rod 232, and a carriage 233. The main guide rod 231 and the sub guide rod 232 serving as guide members extend between the side plates 221A and 221B to support the carriage 233. The carriage 233 supported by the main guide rod 231 and the sub guide member is slidable in a main scanning direction indicated by a double arrow MSD in FIG. 7. The carriage 233 is reciprocally moved for scanning in the main scanning direction MSD by a main scanning motor via a timing belt.

On the carriage 233 is mounted a recording head assembly 234 including liquid ejection heads according to the present exemplary embodiment to eject ink droplets of different colors, for example, yellow (y), cyan (c), magenta (m), and black (k). The recording head assembly 234 is installed to the carriage 233 so that multiple nozzle rows each including multiple nozzles are arranged parallel to a sub-scanning direction (indicated by an arrow SSD illustrated in FIG. 7) perpendicular to the main scanning direction MSD and ink droplets are ejected downward from the nozzles.

In this exemplary embodiment, the recording head assembly 234 includes a liquid ejection head 234*a* and a liquid ejection head 234*b*. Each of the heads 234*a* and 234*b* includes two nozzle rows are mounted to the carriage 233 serving as single head support member in the same manner as the above-described exemplary embodiment. For example, the liquid ejection head 234*a* ejects black ink droplets from one of the nozzle rows and cyan ink droplets from the other of the nozzle rows, and the liquid ejection head 234*b* ejects magenta ink droplets from one of the nozzle rows and yellow ink droplets from the other of the nozzle rows. As described above, in this exemplary embodiment, the two liquid ejection heads each having two nozzle rows eject liquid droplets of four colors. Alternatively, each of the two liquid ejection heads may have four nozzle rows to separately eject ink droplets of four different colors.

A supply unit 224 replenishes different color inks from ink cartridges 210 storing the respective color inks to sub tanks 235 via supply tubes 236 for the respective color inks.

The image forming apparatus further includes a sheet feed section that feeds sheets 242 stacked on a sheet stack portion (platen) 241 of a sheet feed tray 202. The sheet feed section further includes a sheet feed roller 243 that separates the sheets 242 from the sheet stack portion 241 and feeds the sheets 242 sheet by sheet and a separation pad 244 that is disposed opposing the sheet feed roller 243. The separation pad 244 is made of a material of a high friction coefficient and biased toward the sheet feed roller 243.

To feed the sheet 242 from the sheet feed section to an area below the recording head assembly 234, the image forming apparatus includes a first guide member 245 that guides the sheet 242, a counter roller 246, a conveyance guide member 247, a press member 249 including a front-end press roller 249, and a conveyance belt 251 that conveys the sheet 242 to a position facing the recording head assembly 234 with the sheet 242 electrostatically attracted thereon.

The conveyance belt 251 is an endless belt that is looped between a conveyance roller 252 and a tension roller 253 so as to circulate in a belt conveyance direction, that is, the sub-scanning direction (SSD). A charge roller 256 is provided to charge the surface of the conveyance belt 251. The charge roller 256 is disposed so as to contact the surface of the conveyance belt 251 and rotated in accordance with the circulation of the conveyance belt 251. By rotating the conveyance roller 252 by a sub-scanning motor, not illustrated, via a timing roller, the conveyance belt 251 circulates in the belt conveyance direction SSD illustrated in FIG. 7.

The image forming apparatus further includes a sheet output section to output the sheet 242 having an image formed by the recording head assembly 234. The sheet output section includes a separation claw 261 to separate the sheet 242 from the conveyance belt 251, a first output roller 262, a second output roller 263, and a sheet output tray 203 disposed below the first output roller 262.

A duplex unit 271 is removably mounted on a rear portion of the image forming apparatus. When the conveyance belt 251 rotates in reverse to return the sheet 242, the duplex unit 271 receives the sheet 242 and turns the sheet 242 upside down to feed the sheet 242 between the counter roller 246 and the conveyance belt 251. A manual-feed tray 272 is formed at the top face of the duplex unit 271.

Figure 7:
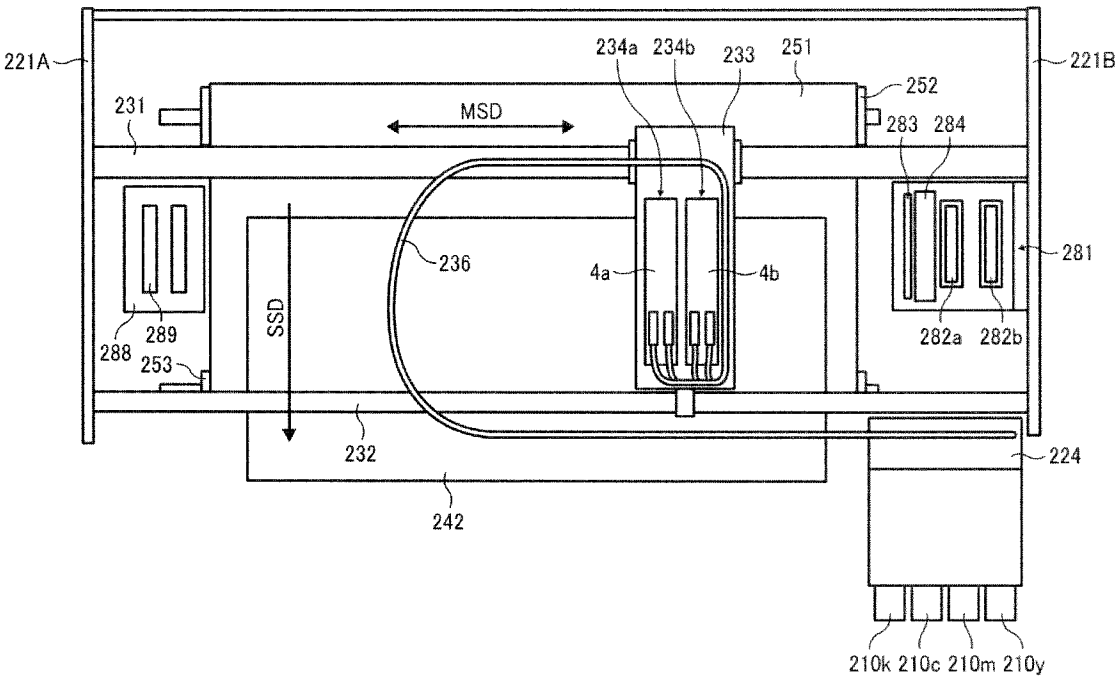
FIG. 7 is a partial plan view of the image forming apparatus illustrated in FIG. 6.

In FIG. 7, at a non-print area on one end in the main scanning direction MSD of the carriage 233 is disposed a maintenance-and-recovery unit 281 to maintain and recover conditions of the nozzles of the recording head assembly 234.

The maintenance-and-recovery unit 281 includes cap members 282*a* and 282*b* (hereinafter collectively referred to as "caps 282" unless distinguished) to cover the nozzle faces of the recording head assembly 234, a wiping blade 283 serving as a wiping member to wipe the nozzle faces of the recording head assembly 234, and a first droplet receiver 284 to store ink droplets during maintenance ejection performed to discharge viscosity-increased recording liquid.

In FIG. 7, a second droplet receiver 288 is disposed at a non-print area on the other end in the main scanning direction MSD of the carriage 233. The second droplet receiver 288 stores viscosity-increased recording liquid or other non-recorded liquid droplets discharged during recording (image forming) operation and so forth. The second droplet receiver 288 has openings 289 arranged in parallel with the nozzles rows of the recording head assembly 234.

In the image forming apparatus having the above-described configuration, the sheets 242 are separated sheet by sheet from the sheet feed tray 202, fed in a substantially vertically upward direction, guided along the first guide member 245, and conveyed with sandwiched between the conveyance belt 251 and the counter roller 246. Further, the front tip of the sheet 242 is guided with the conveyance guide 237 and pressed with the front-end press roller 249 against the conveyance belt 251 so that the traveling direction of the sheet 242 is turned substantially 90 angle degrees.

At this time, plus outputs and minus outputs, i.e., positive and negative supply voltages are alternately applied to the charge roller 256 so that the conveyance belt 251 is charged with an alternating voltage pattern, that is, an alternating band pattern of positively-charged areas and negatively-charged areas in the sub-scanning direction SSD, i.e., the belt circulation direction. When the sheet 242 is fed onto the conveyance belt 251 alternately charged with positive and negative charges, the sheet 242 is electrostatically attracted on the conveyance belt 251 and conveyed in the sub-scanning direction SSD by circulation of the conveyance belt 251.

By driving the recording head assembly 234 in response to image signals while moving the carriage 233, ink droplets are ejected on the sheet 242 stopped below the recording head assembly 234 to form one band of a desired image. Then, the sheet 242 is fed by a certain amount to prepare for recording another band of the image. Receiving a signal indicating that the image has been recorded or the rear end of the sheet 242 has arrived at the recording area, the recording head assembly 234 finishes the recording operation and outputs the sheet 242 to the sheet output tray 203.

Next, an image forming apparatus according to another exemplary embodiment is described with reference to FIGS. 8 and 9.

Figure 8:
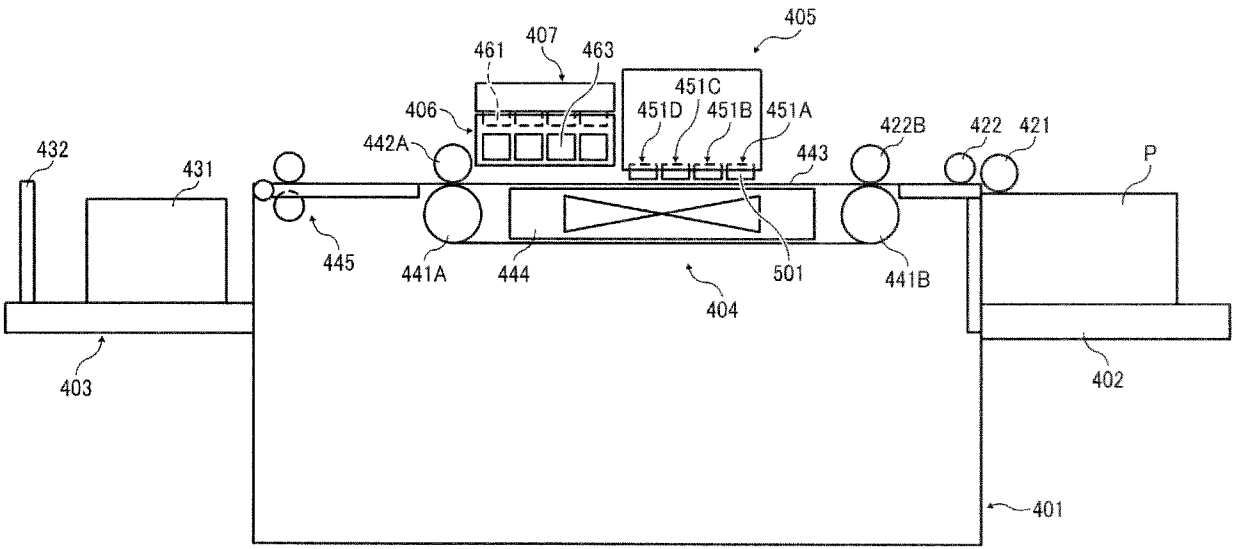
FIG. 8 is a schematic view of an image forming apparatus according to another exemplary embodiment of this disclosure.
Figure 9:
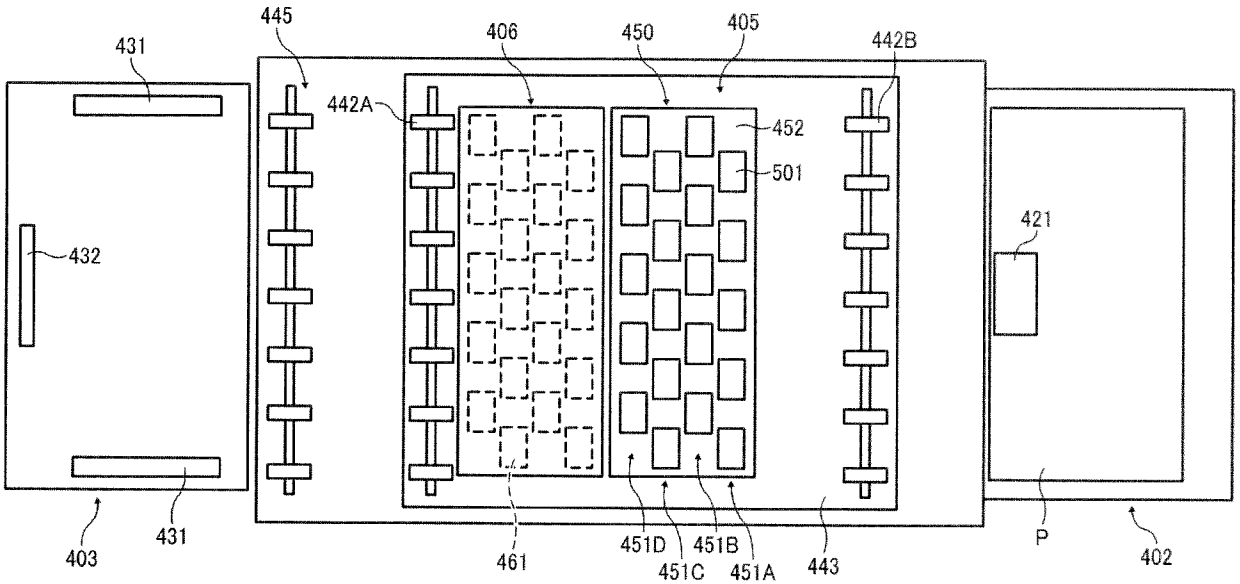
FIG. 9 is a plan view of the image forming apparatus illustrated in FIG. 8.

FIG. 8 is a side view of a schematic configuration of the image forming apparatus. FIG. 9 is a plan view of the image forming apparatus of FIG. 8.

The image forming apparatus is a line-type image forming apparatus and includes an apparatus main body 401, a sheet feed tray 402 to stack and feed sheets P, a sheet output tray 403 to stack printed sheets P, a conveyance unit 404 to convey the sheets P from the sheet feed tray 402 to the sheet output tray 403, a recording head assembly 405 including recording heads to eject liquid droplets to print images on the sheets P conveyed by the conveyance unit 404, a head maintenance device 406 serving as maintenance-and-recovery unit to maintain and recovery conditions of the recording heads of the recording head assembly 405 after printing or at a desired timing(s), and a cleaning device 407 serving as wiper cleaner to clean cap members and a wiping member (blade).

The apparatus main body 401 includes, for example, a front plate, a rear plate, and a stay. The sheets P stacked on the sheet feed tray 402 are fed sheet by sheet with a separation roller 421 and a sheet feed roller 422 to the conveyance unit 404.

The conveyance unit 404 includes a conveyance driving roller 441A, a conveyance driven roller 441B, and an endless conveyance belt 443 extended between the rollers 441A and 441B. Multiple suction holes are formed on the surface of the endless conveyance belt 443, and a suction fan 444 is disposed below the endless conveyance belt 443 to suction the sheet P onto the endless conveyance belt 443. Above the conveyance driving roller 441A and the conveyance driven roller 441B, conveyance guide rollers 442A and 442B are supported with guides, not illustrated, so as to contact the conveyance belt 443 by their own weight.

The conveyance driving roller 441A is rotated by a motor to circulate the endless conveyance belt 443, and the sheet P is attracted onto the endless conveyance belt 443 by suctioning of the suction fan 444 and conveyed in accordance with the circulation of the endless conveyance belt 443. The conveyance driven roller 441B and the conveyance guide rollers 442A and 442B are rotated in accordance with the circulation of the endless conveyance belt 443.

Above the conveyance unit 404, the recording head assembly 405 including the multiple recording heads to eject liquid droplets for printing the sheet P is disposed in a movable manner (e.g., so as to be movable upward and downward in FIG. 8). For example, in maintenance recovery operation, the recording head assembly 405 moves up to a predetermined position to obtain a space into which the head maintenance device 406 moves below the recording head assembly 405.

The recording head assembly 405 has a head array unit (recording head unit) 450 including four head rows 451A, 451B, 451C, and 451D on a base member 452 serving as head support member. Each of the head rows 451A, 451B, 451C, and 451D includes multiple heads 501 (e.g., five heads in FIG. 9) arrayed in a line. Each of the heads 501 has a nozzle face on which multiple nozzles for ejecting droplets are arrayed in two rows, and is mounted on the base member 452 serving as head support member as in the above-described exemplary embodiment.

For example, each of the heads 501 forming the head rows 451A and 451B ejects droplets of yellow (Y) from one nozzle row of the two nozzle rows and droplets of magenta (M) from the other nozzle row of the two nozzle rows. Each of the heads 501 forming the head rows 451C and 451D ejects droplets of cyan (C) from one nozzle row of the two nozzle rows and droplets of black (K) from the other nozzle row of the two nozzle rows. In other words, the recording head assembly 405 has a configuration in which two head rows 451 for ejecting droplets of the same color are arranged side by side in a direction (sheet conveyance direction) in which the sheet P is conveyed and the two head rows 451 form a single nozzle row corresponding to the width of the sheet P. In this case, for example, the two head rows 451 form an image line (band) of 150 dpi.

The line configuration of respective colors is not limited to the above-described configuration, and the colors may be arranged in any other suitable manner. The configuration of the recording head assembly is not also limited to the above-described configuration. For example, two recording head assemblies having the above-described configuration may be arranged side by side, and one color may be allocated to one head row to double the image resolution.

The recording head assembly 405 has branching members to supply respective color inks to the heads 501 of the corresponding head rows 451 and sub tanks upstream from the branching members in a direction (ink supply direction) in which inks are supplied. Difference in liquid level between the sub tanks and the heads forms negative pressure to maintain menisci in the nozzles of the heads 501. Upstream from the sub tanks in the ink supply direction, replaceable main tanks are disposed to store inks.

Downstream from the conveyance unit 404 in the sheet conveyance direction is disposed a conveyance guide unit 445 to discharge the sheet P to the sheet output tray 403. The sheet P is discharged from the conveyance guide unit 445 to the sheet output tray 403. The sheet output tray 403 has a pair of side fences 431 to regulate the width direction of the sheet P and an end fence 432 to regulate a front end of the sheet P.

Above the conveyance unit 404 and at a lateral position to the recording head assembly 405 is disposed the head maintenance device 406 to maintain good conditions of the nozzle faces of the heads 501. The head maintenance device 406 has caps 461 to seal the nozzle faces of the respective heads 501 of the corresponding head rows 451A to 451D, wiping members (wiper blades) of blade shape to wipe the nozzle faces of the respective heads 501, and suction units 463 to suction the interior of the caps 461 for each cap row. For the head maintenance device 406, the suction units 463 suction the interior of the caps 461 with the nozzle faces of the heads 501 being sealed by the caps 461. Thus, viscosity-increased ink is discharged from the nozzles, thus recovering the ejection performance of the heads 501.

The suction units 463 of the head maintenance device 406, channels connecting the caps 461 to the suction units 463, and the pressure chambers, and so on may be disposed outside a rear-side plate of the apparatus main body 401 and connected via passages, such as tubes. Alternatively, in the maintenance and recovery operation, a pressure unit may apply pressure to the interior of the heads 501 from the upstream side instead of or concurrently with the above-described suctioning.

The head maintenance device 406 is disposed so as to be slidable along the sheet conveyance direction above the conveyance unit 404. In the head maintenance, after the recording head assembly 405 moves upward, the head maintenance device 406 moves to a position below the recording head assembly 405. By contrast, in printing, the head maintenance device 406 retreats to a position illustrated in FIG. 8.

Above the head maintenance device 406, the cleaning device 407 is disposed to remove liquid droplets (waste liquid) attached to the caps 461 and a wiper blade. The cleaning device 407 is disposed so as to be moved by a cleaner moving unit upward and downward in a direction perpendicular to a surface of the sheet P conveyed on the conveyance belt 443. After the maintenance, in a state in which the head maintenance device 406 retreats to a position lateral to the recording head assembly 405, the cleaning device 407 moves downward to clean the caps 461 and the wiper blade.

In the above-described exemplary embodiments, the image forming apparatus is described as printer. However, the image forming apparatus is not limited to such printer and may be, for example, a multifunctional device having two or more capabilities of printer, facsimile machine, and copier. In addition, as described above, the image forming apparatus may be an image forming apparatus employing, e.g., a liquid other than ink in narrow meaning or a fixing treatment liquid.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a plurality of heads to eject liquid droplets, each of the plurality of heads having multiple nozzles arrayed in at least one row to eject liquid droplets; and a head support member to mount the plurality of heads, the head support member having a first positioning portion and a second positioning portion to position each of the plurality of heads, wherein each head amongst the plurality of heads has a first positioning face disposed in a first portion of the head, to position the head, in a nozzle array direction in which the nozzles of the head are arrayed in at least one row and a second positioning face to position the head in a direction perpendicular to the nozzle array direction, the first positioning face and the second positioning face are cut faces formed by cutting, each of a first distance between the first positioning face and a first reference nozzle of the nozzles of each of the plurality of heads and a second distance between the second positioning face and a second reference nozzle of the nozzles of each of the plurality of heads is uniform between the plurality of heads, and each of the plurality of heads is mounted to the head support member with the first positioning face and the second positioning face contacting the first positioning portion and the second positioning portion, respectively, and wherein said each head amongst the plurality of heads has (i) two third positioning faces disposed in the first end portion of the head and (ii) another third positioning face disposed at a second end portion opposite the first end portion in the nozzle array direction of the head, to position the head in a droplet ejection direction in which liquid droplets are ejected from the nozzles of the head, each of the third positioning faces and another third positioning face is a cut face formed by cutting, the head support member has third positioning portions corresponding to said two third positioning faces and another third positioning face, respectively, to position each of the plurality of heads, a third distance between each of said third positioning faces and another third positioning face and a nozzle face of each of the plurality of heads is uniform between the plurality of heads, and each of the plurality of heads is mounted to the head support member with said third positioning faces and another third positioning face contacting the respective third positioning portions of the head support member.

2. The image forming apparatus according to claim 1, wherein the first reference nozzle and the second reference nozzle are located at least one end of the at least one row in which the nozzles of each of the plurality of heads are arrayed in the nozzle array direction.

3. The image forming apparatus according to claim 1, wherein each of the plurality of heads has a frame member including a common chamber and the first positioning face and the second positioning face are formed on the frame member.

4. The image forming apparatus according to claim 1, wherein each of the plurality of heads has a frame member including a common chamber and the third positioning face is formed on the frame member.

5. A method of making an image forming apparatus having a plurality of heads to eject liquid droplets, each of the plurality of heads having multiple nozzles arrayed in at least one row to eject liquid droplets; and a head support member to mount the plurality of heads, the method comprising:

(a) aligning each head amongst a plurality of heads with respect to at least (I) a rotation direction around an axis parallel to a nozzle array direction in which nozzles of the head are arrayed in at least one row and (II) a rotation direction around an axis perpendicular to the nozzle array direction, after the head has been assembled;

(b) cutting, after (a) and for said each head amongst the plurality of heads, at least one portion of an outer surface of the head in each direction of a nozzle array direction in which nozzles of the head are arrayed in at least one row and a direction perpendicular to the nozzle array direction at a predetermined distance from a given reference nozzle of the nozzles of the head to form a first positioning face in a first end portion of the head in the nozzle array direction and a second positioning face in the direction perpendicular to the nozzle array direction;

(c) cutting, after (a), an outer surface of said each head in a droplet ejection direction in which liquid droplets are ejected from the nozzles of the head to form (i) two third positioning faces disposed in the first end portion of the head and (ii) another third positioning face disposed in a second end portion opposite the first end portion, in the nozzle array direction;

(d) contacting the first positioning face and the second positioning face with a first positioning portion and a second positioning portion, respectively, of the head support member to mount each of the plurality of heads to the head support member; and (e) contacting said third positioning faces and another third positioning face of said each head with respective third positioning portions of the head support member, to position the head in the droplet ejection direction.

6. The method according to claim 5, wherein the first positioning face and the second positioning face are concavely formed on respective surfaces of said each of the plurality of heads.

7. The image forming apparatus according to claim 1, wherein the first positioning face and the second positioning face are concavely formed on respective surfaces of said each of the plurality of heads.

8. The image forming apparatus according to claim 1, wherein the first positioning surface is formed on an outer surface of said each of the plurality of heads which is perpendicular to the nozzle array direction, and the second positioning surface is formed on an outer surface of said each of the plurality of heads which is parallel to the nozzle array direction.

* * * * *